US005560238A

United States Patent [19]

Allebach et al.

[11] Patent Number: 5,560,238

[45] Date of Patent: Oct. 1, 1996

[54] THREAD ROLLING MONITOR

[75] Inventors: Gene E. Allebach; Dennis N. Roush, both of Tiffin, Ohio

[73] Assignee: The National Machinery Company, Tiffin, Ohio

[21] Appl. No.: 344,090

[22] Filed: Nov. 23, 1994

[51] Int. Cl.[6] ..... B21H 3/06

[52] U.S. Cl. ..... 72/13.4; 72/31.01; 72/90

[58] Field of Search ..... 72/88, 90, 35, 72/36, 21, 8, 20.1, 31.01, 13.4

[56] References Cited

U.S. PATENT DOCUMENTS

| | | | |
|---|---|---|---|
| 1,979,919 | 11/1934 | Wayne | 80/9 |
| 3,926,026 | 12/1975 | Jackson | 72/90 |
| 4,059,794 | 11/1977 | Furness | 72/35 |
| 4,131,250 | 7/1992 | Smith et al. | 72/90 |
| 4,202,192 | 5/1980 | Haneda | 72/21 |
| 4,229,966 | 10/1980 | Jackson | 72/469 |
| 4,615,197 | 10/1986 | Allebach . | |

FOREIGN PATENT DOCUMENTS

| | | | |
|---|---|---|---|
| 3127462 | 3/1983 | Germany | 72/90 |
| 2372 | 1/1978 | Japan | 72/21 |
| 309340 | 12/1988 | Japan | 72/88 |

*Primary Examiner*—Daniel C. Crane

*Attorney, Agent, or Firm*—Pearne, Gordon, McCoy & Granger

[57] ABSTRACT

A thread rolling machine in which the dies are monitored for a mismatch condition by a proximity sensor responsive to displacement of the moveable die in a direction parallel to the axis of the workpiece. This displacement, which occurs when a mismatch condition exists, is permitted by the running clearances in the slide carrying the moveable die. When more than a negligible displacement occurs, corrective action can be taken to reject out of specification workpieces and to adjust the relative positions of the dies to maintain them in a matched condition.

11 Claims, 4 Drawing Sheets

THREAD ROLLING MONITOR

BACKGROUND OF THE INVENTION

The invention relates to thread rolling machines and, more particularly, to a thread rolling machine incorporating improved means to monitor the thread rolling operation while the machine is running.

PRIOR ART

Flat die thread rolling machines generally provide a fixed die holder and a movable die holder which reciprocates back and forth adjacent to the fixed die holder. A pair of dies are mounted on the die holders and when a pusher inserts a blank or workpiece between the dies, a thread or other desired form is rolled on the blank surface as the blank rolls between the reciprocating dies.

In order for the threads to be properly formed in a reliable manner, it is essential that the dies be precisely positioned with respect to each other, and that the machine operates through repeated cycles in a uniform manner so that each successive blank is rolled in exactly the same way. There are a number of different conditions which can exist to cause improper rolling operation.

For example, one of the dies may be adjusted too high or too low relative to the other die at the position where the blank starts through the dies. This produces a condition generally referred to as "mismatch" of the dies. When a mismatch condition occurs, the thread forms made on the workpiece by one die do not properly match the thread forms on the other die, e.g. they are too high or too low. When this occurs, a reaction force is developed in a direction parallel to the axis of the workpiece. On the other hand, when the dies and workpiece are properly matched, such reaction force does not exist, or is very small.

Traditionally, the match of the dies has been determined during the set-up of the dies and not while the machine is running. During set-up, a blank is fed into the dies and the machine is jogged to cause the blank to be rolled through one-half a turn. The blank is then backed out and inspected to see if the thread forms on the two halves of the blank are aligned. If proper alignment is not present, the dies are adjusted and the process is repeated. Because the machine was not running during this operation, a proper running match might not be provided even though the non-running set-up provided a proper match. My U.S. Pat. No. 4,615,197 discloses a monitoring system for a thread rolling machine. The invention of this patent has contributed an advance to the state-of-the-art. However, this system has not been commercially accepted because experience in the field has shown that less than completely sanitary conditions will foil its successful operation. Where overlooked debris, lubricants, burrs and the like exist, the system may operate erratically or otherwise unsatisfactorily. Machine operators particularly interested in production, for example, may be unwilling or unable to exercise the required degree of care in installing a new die set and maintaining the proper conditions in the die environment to such a degree as to enable the system to operate as designed.

SUMMARY OF THE INVENTION

The invention provides an improved method and apparatus for electronically monitoring the match of a pair of operating thread rolling dies. The invention is based on the principle that when the dies are operating in a mismatched condition, a force, in one or the other lateral direction parallel to the axis of the blank being rolled will be developed by a cam-like action between the surfaces of the blank threads and dies. This force will tend to cause a corresponding lateral displacement between the dies. In accordance with the invention, this relative lateral displacement between the dies in a direction parallel to the axis of a blank being rolled, which displacement or movement is indicative of a mismatch, is detected with a suitable sensing device having a measurement capacity at least of the same order of magnitude as a desired or specified tolerance in a match.

More specifically, in the preferred embodiment, the movable die is monitored for mismatch indicating lateral movement. This technique allows the mismatch indicating movement to take place within a bearing clearance that at least to some degree is ordinarily provided in the support of the movable die. The movable die, as disclosed, is resiliently supported by a spring suspension that biases it to the center of the running clearance.

As a result, the movable die can be displaced in either lateral direction parallel to the axis of a blank in response to a force in either of these directions. The sensor is arranged to detect lateral displacement in either direction and to signal a data registering device to record the displacement in magnitude and direction. The data can then be used to make running adjustments of the match of the dies to maintain quality production and/or reject out-of-specification product.

The sensor and related circuitry are calibrated such that their capacity of measurement is at least of the same order of magnitude as a practical tolerance for a match which is considered to be essentially exact. For example, where the dies are in registration with one another in the lateral direction of the axis of the blank within plus or minus 0.0005 inch, the match can be considered "exact" and in such case, the measurement capacity of the sensor and related circuitry is at least in the order of 0.0005 inch or greater. In this way, quite adequate measurement of the match is obtained while the sensor and related circuitry are, from a practical sense, oblivious to small sources of errors in the nature of unnoticed dirt, debris, nicks, burrs and warpage on the dies or holders.

DESCRIPTION OF THE PREFERRED EMBODIMENT

Figure 1:
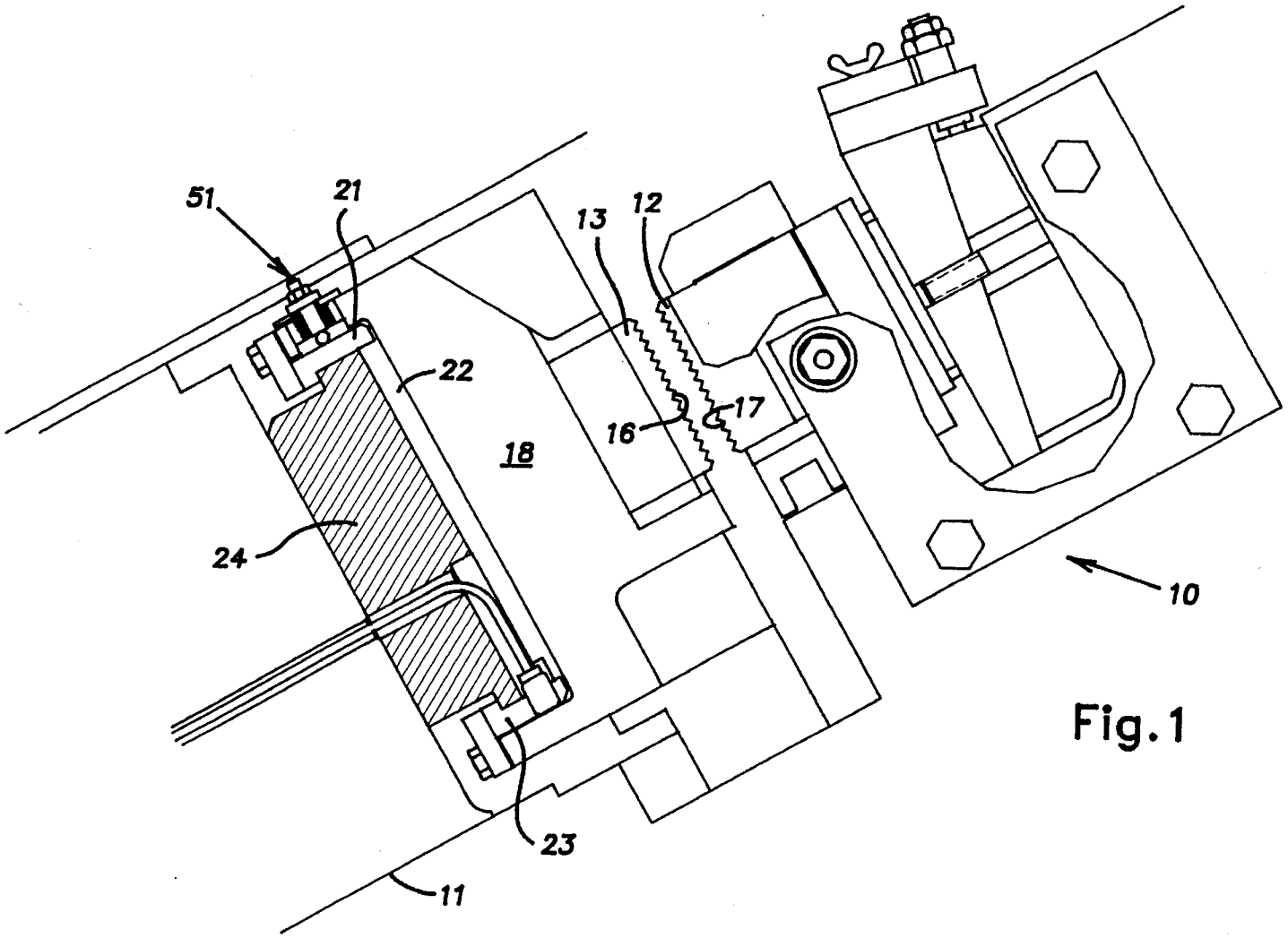
FIG. 1 is a fragmentary side elevation of a thread rolling machine illustrating the support for the reciprocating die and the stationary die.

Referring now to the drawings, a thread rolling machine 10 has a frame 11. Opposed flat dies 12 and 13 carried on the frame 11, in a generally known manner, are reciprocated relative to one another to roll threads or other forms on a cylindrical part of a blank 14 to form a bolt or the like. The die 12 is mounted stationarily on the frame 11 while the other die 13, referred to herein as the movable die, reciprocates in translation relative to the stationary die. Reference can be made to U.S. Pat. No. 5,131,250, the disclosure of which is incorporated herein by reference, for greater details in the construction of the threading machine. Working faces 16 and 17 of the dies 12 and 13 are in parallel spaced relation to one another and are made with grooves that form the threads of the cylindrical blank 14. The axis of the blank 14 is parallel to the working faces of the dies 12 and 13 and perpendicular to the length of the dies and the direction of reciprocation of the movable die 13.

The stationary die 12 when mounted in the machine is precisely adjustable in its parallel relation and spacing to the movable die 13. The movable die 13 is carried on a slide or holder 18 that reciprocates back and forth in translation. The slide 18 glides on bearing liners 21, 22 and 23 fixed on a bearing block 24 that is bolted stationarily onto the frame 11. Oil lubrication is introduced to the faces of these liners 21–23 supporting the slide 18 in a known manner.

Figure 4:
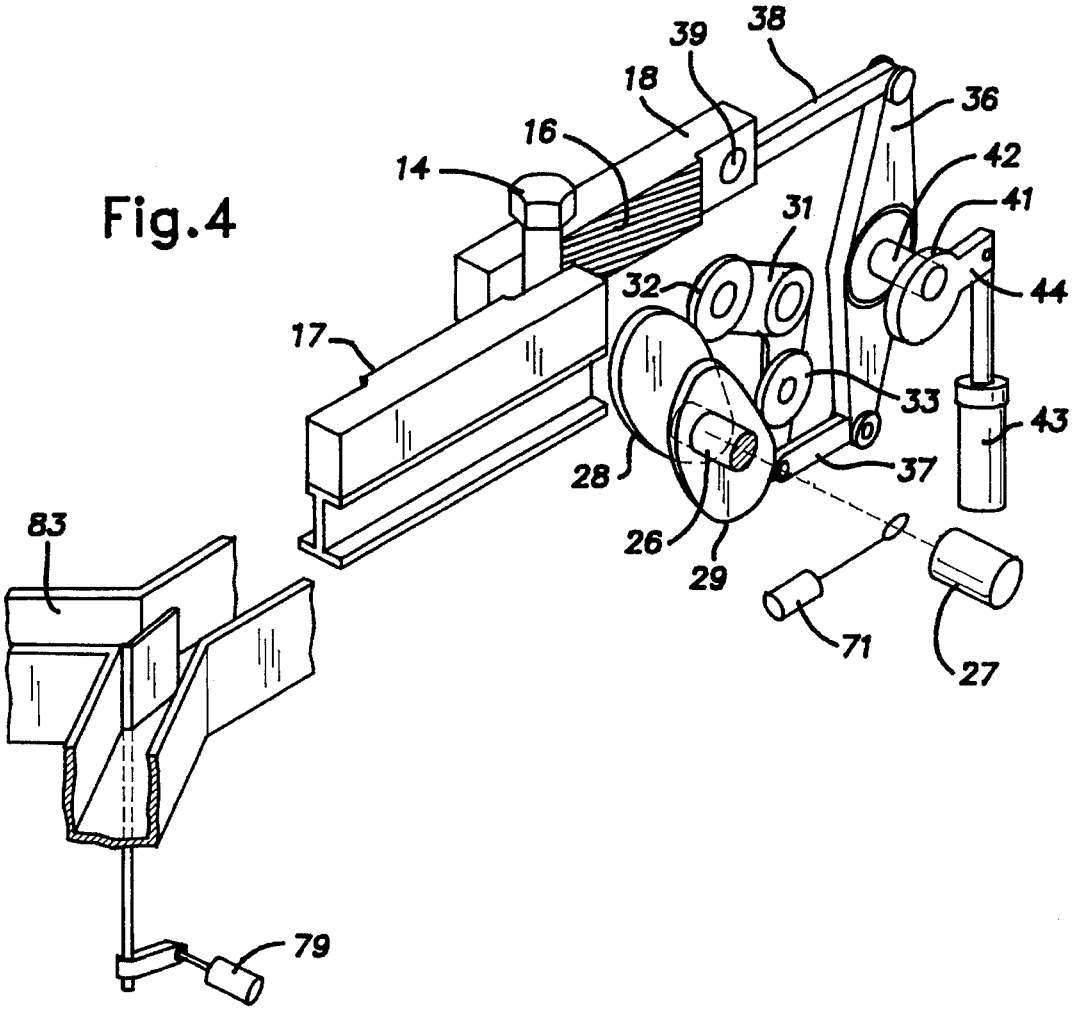
FIG. 4 is a diagrammatic representation of the drive for the movable die holder and die.

FIG. 4 diagrammatically illustrates the drive for reciprocating the slide 18 and movable die 13. A cam shaft 26 journalled on the frame 11 and driven by a suitable motor 27 has a pair of complimentary cams 28, 29. As the cam shaft 26 is rotated by the motor 27 the cams 28, 29 oscillate a bell crank lever 31 through cam follower rollers 32, 33. The bell crank lever 31, in turn, oscillates a lever 36 through a connecting link 37. The lever 36 has a connecting rod 38 pinned to the slide 18 at a center 39. As the cam shaft 26 turns, the slide 18 reciprocates. An adjustment of the position of the movable die 13 in either direction of its reciprocation can be made by rotation of an eccentric shaft 41 on which the lever 36 oscillates. In particular, a pivot center 42 for the lever 36 on the shaft 41 is eccentric to the axis of the shaft 41. The shaft 41 is turned as necessary in one direction or the other by a hydraulic piston and cylinder actuator 43 operating on a crank arm 44 fixed to the shaft 41. It will be understood that this adjustment can be made while the machine 10 is operating, i.e. while the cam shaft 26 is rotating and the slide 18 is reciprocating.

Figure 2:
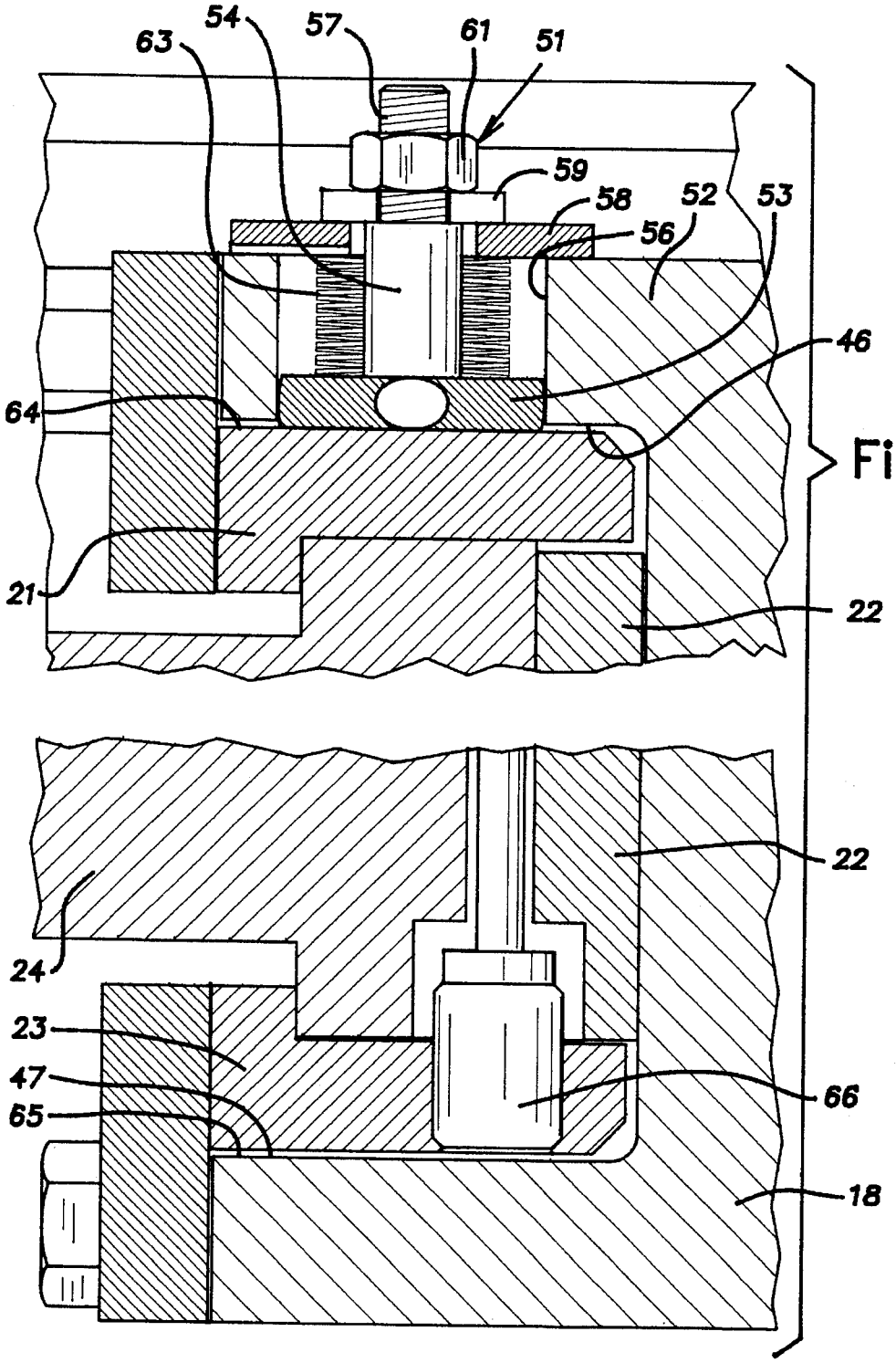
FIG. 2 is a fragmentary view similar to FIG. 1 on a somewhat enlarged scale and illustrating features of the suspension of the reciprocating or movable die and an associated displacement sensor.

FIG. 2 illustrates details of the support of the movable die 13 and slide 18 on the frame 11 through the fixed bearing block 24. The machine 10 can be constructed as illustrated with the working faces 16, 17 of the dies 12 and 13 being tilted from the vertical. For convenience in the description, this tilt will be ignored and it will be assumed that these faces 16, 17 are in vertical planes and the axis of the blank being formed is vertical. It will be understood, however, that the invention can be applied to machines where the die faces have any desired orientation. The liners 21 and 23 are dimensioned with respect to the proportions of opposing slide surfaces 46, 47 to provide a predetermined clearance of, for example, 0.005 inch in the vertical direction. That is, the total of any gaps between the slide surface 46 and associated liner 21 and surface 47 and liner 23 equals such predetermined clearance.

Figure 3:
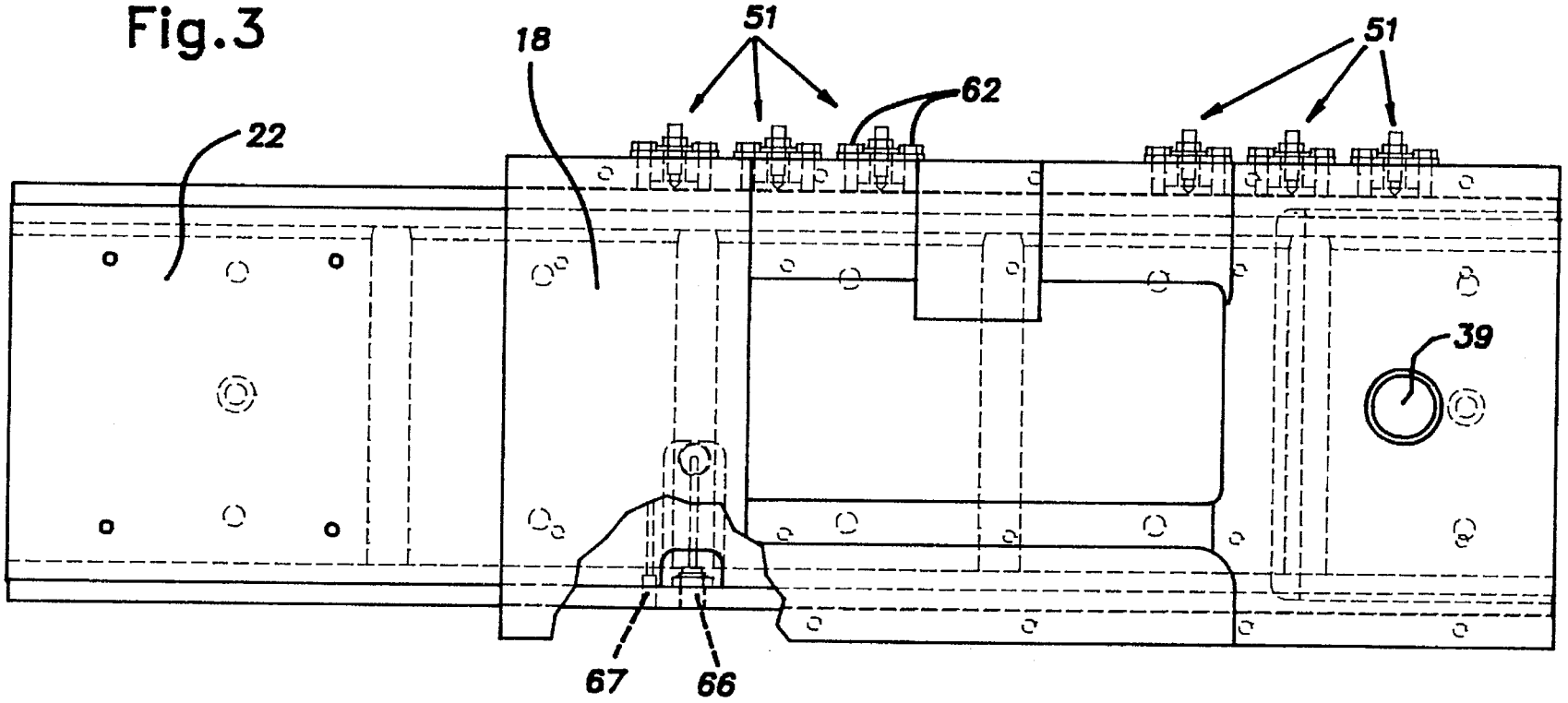
FIG. 3 is an elevational view of the movable die holder and bearing block assembly.

A plurality of spring plunger assemblies 51 are disposed along the length of the slide 18 on its upper flange designated 52. The plunger assemblies 51 support the weight of the slide 18 and die 13 to normally maintain the slide vertically centered with equal clearances of, for example, 0.0025 inch at the top and bottom liners 21, 23, respectively. One type of plunger assembly 51 is illustrated in an enlarged scale in FIG. 2. The plunger assembly 51 has a circular body comprising a head 53 and a shank 54. The plunger assembly 51 is assembled in a respective vertical hole 56 through the flange 52. A set screw 57 of the assembly 51 extends through a hole in a keeper plate 58 and a retaining washer 59. A nut 61 retains the washer on the stem or set screw 57. Each plate 58 is secured to the slide flange 52 by suitable bolts 62 (FIG. 3). A plurality of disc springs 63 is stacked on the shank 54 of each plunger assembly 51. The plunger body head 53 is arranged to project below the face 46 a distance equal to one-half of the nominal clearance of 0.005 inch between the slide 18 and liners 21 and 23, this projection, in the illustrated embodiment, being 0.0025 inch. When the nut 61 is tightened on the set screw 57, the springs 63 are preloaded with a predetermined force. The sum of the preload forces of the number of plunger assemblies 51, being used and as constituted in FIG,. 2, determines the vertical force on the slide 18, assisted by the weight of the slide and die 13, required to displace it downwardly from its centered position.

A variant of the plunger assembly 51 takes a form like that illustrated in FIG. 2 except that the lock nut 61 is omitted. The spring set 63 in this variant type of plunger assembly 51 tends to lift the weight of the slide 18 and die 13. The number of these variant plunger assemblies and the sum of their spring set design forces determines the vertical force required to lift the slide 18 from the centered position.

From the foregoing discussion, it will be understood that the slide 18 will be maintained in its centered position unless a predetermined downward force, governed by the number and spring preload of plunger assemblies 51 like that illustration in FIG. 2 is exceeded or a predetermined upward force, governed by the number and spring forces of plunger assemblies without lock nuts is exceeded. In one preferred embodiment, these predetermined threshold forces required to move the slide 18 and die 13 up or down from its centered position are selected to be about ⅓ of the weight of the slide, although there is no requirement that these upward and downward values be the same. By keeping these threshold forces relatively low, where some mismatch exists the risk of shearing off the threads being formed on a blank is reduced.

A downward force on the movable die 13 exceeding the predetermined downward threshold force will tend to cause it and the slide to move downwardly in response thereto by virtue of the plunger heads 53 retracting into their respective holes 56 until they are essentially flush with the associated slide surface 46 and the latter approaches contact with the bearing liner 21. Conversely, an upward force on the die 13 exceeding the predetermined upward threshold force will cause the slide to rise until the surface or face 47 of the lower flange of the slide 18 is in near contact with the lower liner 23. Theoretically where the slide 18 is operating in reciprocation, and lubricating oil is supplied to the surfaces of the liners 21–23, actual contact between the slide and liners is prevented by a boundary of oil. Movement, up or down, of the slide 18 is essentially frictionless, apart from the shear friction of the lubricating oil on the liner 22. The large flat surface area of the liner 22 ensures that the unit pressure of the lubricating oil remains low during operation of the slide so that metal to metal contact is avoided.

A proximity sensor 66 is mounted in the lower side of the bearing block 24 and the associated liner 23 near their mid-length (FIG. 3). As described below, the proximity sensor 66 is capable of accurately measuring vertical displacement of the die 13 and slide 18 relative to the bearing block 24 which is rigidly fixed to the frame 11. Adjacent to the proximity sensor 66 is a temperature sensor or thermocouple 67 arranged to monitor the temperature of the environment of the proximity sensor.

Figure 5:
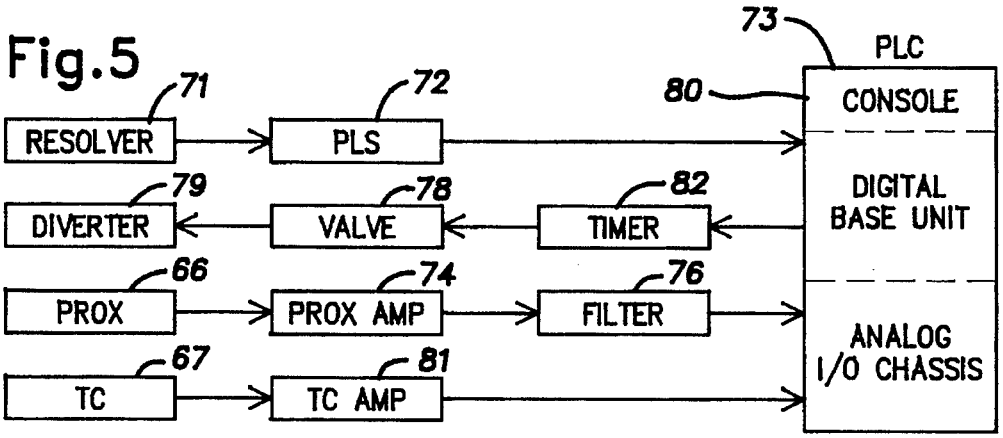
FIG. 5 is a diagrammatic representation of the electronic components of the sensor system.

The invention relies on the principle that during operation of the threading machine 10 a mismatch condition between the dies will manifest itself by development of a vertical force of the dies imposed through a blank being rolled. The force results from the thread forming pressures which are unbalanced because the individual dies are attempting to form threads at slightly different axial locations on the blank. FIG. 5 diagrammatically illustrates a microprocessor-based system for recording the instantaneous vertical displacements of the movable die 13 with the slide 18 during operation of the threading machine 10. A rotary position transducer or Resolver 71 fixed directly on the cam shaft 26 or positively driven by it and a programmable limit switch PLS 72 convert the rotary or angular position of the cam shaft 26 into a digital timing window signal that tells a programmable logic controller PLC 73 when threads are being rolled. The proximity sensor 66, a proximity sensor amplifier PROX AMP 74 and a Filter 76 provide an analog position signal to the PLC 73 that indicates the vertical position of the slide 18 and movable die 13. When the PLC 73 detects the start of the timing window, the position signal is read repeatedly at a high rate until the PLC 73 detects the end of the timing window. The successive readings of the position signal are summed during the timing window and averaged immediately after the end of the timing window. The PLC then reads an analog correction signal supplied by the temperature sensor or TC 67 and a temperature sensor amplifier or TC AMP 81. This correction signal can be required where the output of the sensor or prox 66 drifts as temperature changes.

The sensor 66 and amplifier 74 are arranged to provide a capacity of displacement measurement of the slide that generally is at least of the same order of magnitude as the largest dimension of mismatch which, in a given application, is considered negligible. In common applications, a mismatch of 0.0005 inch can be considered good, i.e. a negligible variation, and in such cases the sensor 66 and amplifier 74 will be arranged with a measurement capacity of at least 0.0005 inch. Preferably, the sensor 66 and amplifier 74 are capable of measuring displacements at least as great as the clearance of 0.005 inches provided by the liners 21 and 23. This technique of providing a relatively large displacement measurement capacity with the measurement sensor and amplifier, allows them to be essentially oblivious to or ignore extraneous displacements or strains that are associated with burrs, nicks, dirt, debris, clamping distortion and other variable factors that inevitably are encountered with the dies and their mounting during service operation of the machine 10.

The position signal average is combined with the correction signal to yield an average slide position. The average slide position is displayed on a console 80 along with an indication or display of the appropriate one of the following terms: MATCHED, LO, HI, LO FAULT or HI FAULT. These display terms correspond to deviations from an idea slide position and are based on limit values for the average slide position entered through the console by the threader operator. If LO FAULT or HI FAULT are indicated, the PLC 73 causes a timer 82 to generate a reject signal to a valve 78 and diverter 79 of sufficient duration to dump any faulty product into a scrap chute 83 (FIG. 4).

More specifically, where the average slide position is very close to the ideal, the display will read MATCHED indicating that the position of the dies 12, 13 are matched when a blank is being rolled. Where the deviation from ideal is moderate and still producing acceptable product, the display will indicate LO or HI depending on if the movable die 13 is displaced downwardly or upwardly from the centered position described above where the clearance between the slide is equal above and below the liners 21 to 23. From the foregoing it will be understood that the threader operator can watch the display of the console and where a LO or HI display persists, can make a running adjustment by actuating the actuator 43 in the appropriate direction to shift the movable die 13 forwardly or rearwardly as required to return the registration of the dies to a MATCHED condition.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

We claim:

1. A thread rolling apparatus comprising a frame, a stationary die and a movable die, said dies having mutually opposed faces for engaging and forming a workpiece, means carrying said dies on said frame, said carrying means including a bearing supporting the movable die for reciprocation in a line parallel to said faces, said carrying means allowing said dies to be displaced relative to one another in a direction parallel to the axis of the workpiece being rolled a distance at least as great as a maximum value of a mismatch between the thread form of the dies which is considered negligible and a sensor on said frame arranged to measure the relative displacement of said dies parallel to the axis of the workpiece due to a mismatch condition between the dies and provide an electrical signal indicating the direction of such measured displacement.

2. A thread rolling apparatus as set forth in claim 1, wherein said sensor is a non-contact proximity sensor.

3. A thread rolling apparatus as set forth in claim 1, including electronic means for registering the signal generated by said sensor.

4. A thread rolling apparatus as set forth in claim 1, wherein said sensor is arranged to sense movement of said movable die in said direction parallel to the axis of the workpiece.

5. A thread rolling apparatus comprising a frame, a stationary die fixed to said frame and a slide carrying a movable die, said dies having mutually opposed faces for engaging and forming a workpiece, a bearing supporting the slide for reciprocation in a line parallel to said faces, said bearing having a clearance allowing said slide and movable die to be displaced relative to said stationary die in a direction parallel to the axis of the workpiece being rolled a distance at least as great as a maximum value of a mismatch which is considered negligible and a sensor on said frame arranged to measure the relative displacement of said slide and moveable die in the direction parallel to the axis of the workpiece due to a mismatch condition between the dies and provide an electrical signal indicating the direction of such measured displacement.

6. A thread rolling apparatus as set forth in claim 5, including spring elements to resiliently support said slide midway in said bearing clearance.

7. A thread rolling apparatus as set forth in claim 6, wherein said spring elements are arranged to maintain the slide midway in said bearing clearance until a predetermined lateral force in one direction or a predetermined lateral force in the opposite direction is developed as a result of a mismatched condition of said dies.

8. A thread rolling apparatus as set forth in claim 5, including means for adjusting the match of said dies while the apparatus is operating with the slide reciprocating.

9. A thread rolling apparatus as set forth in claim 5, including means to automatically reject workpieces that exhibit a mismatch condition greater than a predetermined value.

10. A thread rolling apparatus as set forth in claim 5, wherein said slide is supported against blank rolling forces by a flat lubricated bearing surface that avoids high friction resistance to lateral movement of said slide.

11. A thread rolling apparatus including a pair of dies mounted on a frame and having opposed faces constructed and arranged to move relative to one another in a rolling direction, one of said dies being supported on the frame in a manner permitting it to move relative to the other die in a direction parallel to the axis of a workpiece being rolled a distance at least as great as the maximum value of a mismatch condition considered to be negligible, and a sensor for detecting the value of the movement of said one die relative to the other in the direction parallel to the axis of the workpiece due to a mismatch condition between the dies whereby corrective action to adjust the match between the dies can be taken to assure formation of satisfactory threads on the workpieces.

* * * * *